US006688903B2

(12) United States Patent
Kakinoki et al.

(10) Patent No.: US 6,688,903 B2
(45) Date of Patent: Feb. 10, 2004

(54) CONNECTOR DEVICE, INTERFACE MODULE USING THE CONNECTOR DEVICE, AND ADAPTER FOR CHANGING THE NUMBER OF CORES OF A CONNECTOR

(75) Inventors: Wataru Kakinoki, Yokohama (JP); Masanori Tsubono, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 29 days.

(21) Appl. No.: 09/816,022

(22) Filed: Mar. 23, 2001

(65) Prior Publication Data

US 2002/0068476 A1 Jun. 6, 2002

(30) Foreign Application Priority Data

Mar. 24, 2000 (JP) ..... 2000-085404

(51) Int. Cl.[7] ..... H01R 13/637
(52) U.S. Cl. ..... 439/362
(58) Field of Search ..... 439/362, 359, 439/360

(56) References Cited

U.S. PATENT DOCUMENTS 5,244,405 A * 9/1993 Broschard, III et al. .... 439/362
5,324,209 A * 6/1994 Falossi et al. ..... 439/362

FOREIGN PATENT DOCUMENTS

| | | |
|---|---|---|
| JP | 58-157984 | 10/1983 |
| JP | 63-192683 | 12/1988 |
| JP | 1-168974 | 11/1989 |

* cited by examiner

*Primary Examiner*—Javaid Nasri
(74) *Attorney, Agent, or Firm*—Keating & Bennett, LLP

(57) ABSTRACT

A connector device includes lock male screws which can be screwed to lock female screws of an apparatus on which a locking operation is carried out, nuts for freely inserting the lock male screws and for allowing movement of the lock male screws between a screwed position and a non-screwed position, and lock female screws which, with the lock male screws being retracted to the non-screwed positions, are screwed to the nuts, and which are screwed to lock male screws of the apparatus on which a locking operation is carried out. By switching the states of the lock female screws between a mounting state and a non-mounting state with respect to the nuts, the lock screws of the connector device can be used even if the forms of the lock screws change with respect to the connector device. This causes the female connector and the male connector to be firmly secured together, thereby making the connector device more versatile.

20 Claims, 5 Drawing Sheets

CONNECTOR DEVICE, INTERFACE MODULE USING THE CONNECTOR DEVICE, AND ADAPTER FOR CHANGING THE NUMBER OF CORES OF A CONNECTOR

BACKGROUND OF THE INVENTION

1. Field of the Invention

The present invention relates to a connector device, and, more particularly, to improvements in a connector device having a lock screw for maintaining the connection of male and female connectors which are connected to each other, an interface module using the connector device, and an adapter for changing the number of cores of a connector.

2. Description of the Related Art

Conventionally, when a peripheral device (such as a printer, a storage device, or a display device) is connected to, for example, a computer or a communications apparatus, a connector device having a plurality of connecting elements is used. For example, as shown in FIG. 6A, a female connector 102 having a plurality of female connecting elements 102*a* used for inputting and outputting signals is provided on, for example, the back surface of an apparatus 100 such as a computer. On the other hand, as shown in FIG. 6B, a connector device 106 is provided on an end of a cable 104 which extends from, for example, the peripheral device. A male connector 108 having male connecting elements 108*a* which engage the female connecting elements 102*a* is provided on an end of the connector device 106. In general, to reliably and stably connect the female connector 102 and the male connector 108, lock screws are provided on the apparatus 100 and the connector device 106, respectively. Usually, lock female screws (that is, female screws on which a locking operation is carried out) are provided on the apparatus 100 (that is, at the side of the connector to which a connection is made), whereas lock male screws 112 are provided on the connector device 106. The lock male screws 112 freely advance and retreat in the directions of double-headed arrows A with respect to a connector housing 114. As shown in FIG. 6C, with the female connector 102 and the male connector 108 being connected to each other, by rotating the lock male screws 112 and screwing them into their corresponding lock female screws 110, the connection between the female connector 102 and the male connector 108 is maintained. Similarly, when an interface module is connected to the apparatus 100, the interface module is provided as follows. A male connector 108 having a structure which is similar to that of the connector device 106 is provided at the end of the interface module which is connected to the apparatus 100, while, for example, a connector having a different configuration is provided at the other end.

The connector device 106 described above can be connected to any apparatus as long as the apparatus has a female connector 102 which connects to the male connector 108 of the connector device 106. By using the lock screws, a faulty connection is easily and reliably prevented (that is, signal communication failure) between the female connector 102 and the male connector 108, and the female connector 102 and the male connector 108 can easily be separated from each other when connection needs to be made to a different device. A connector having a shape similar to the letter D, such as that shown in FIG. 6B, is called a D-Sub connector and is often used in computers.

However, depending on the type of apparatus to which the connector device is connected, the apparatus may have a female connector or a male connector. Therefore, it is necessary to provide a special-purpose connector device having a connector having a configuration that corresponds to the connector of the apparatus. In other words, it is necessary to provide a connector device having a male connector when the apparatus has a female connector, whereas it is necessary to provide a connector device having a female connector when the apparatus has a male connector. However, often the connector device is fixedly provided on a cable led out from a peripheral device or the connector device is integrally provided with, for example, an interface module. Therefore, when the male/female configuration of the connector arbitrarily changes depending on the apparatus, the configuration of the connector of the apparatus may be the same as the configuration of the connector of the connector device, thereby making it impossible to connect the connectors together.

In general, peripheral devices and interfaces are often continually used even when the apparatus, such as a computer, is changed, so that providing a special-purpose connector according to the type of apparatus is not economically reasonable. In such a case, the use of the following simple mechanism may be considered. Here, a low-cost changing cable which changes the male/female configuration of the connector (that is, for example, a cable having a lock male screw and a connector of the same shape at each end thereof) is used to change the configuration of the connector of the apparatus to correspond to the configuration of the connector of the peripheral device, whereby the apparatus and the connector device are connected together. However, lock male screws are provided on the changing cable and the connector of the peripheral device, such that the lock screws cannot be used during the connecting operation. Therefore, even if the male and female connectors are connected through, for example, a cable, the connection of the male and female connectors is not guaranteed, thereby resulting in the problem that the reliability of the connection is reduced.

SUMMARY OF THE INVENTION

To overcome the above-described problems with the prior art, preferred embodiments of the present invention provide a highly reliable, versatile connector device which does not require a special-purpose component even when the configuration of a connector to which a connection is made (that is, the connector of an apparatus) is arbitrarily selected from a male and a female configuration, and which makes it possible to use a lock screw for connecting male and female connectors together even when it is not possible to use the lock screw to firmly secure the connector device to the connector of the apparatus.

To this end, according a first preferred embodiment of the present invention, a connector device is uniquely constructed to allow maintenance of a connection of a female connector and a male connector with each other. The connector device includes a lock male screw, and a mounting opening. The lock male screw is screwable to a lock female screw, on which a locking operation is carried out, of a connector side to which a connection is made. The mounting opening is used for inserting the lock male screw therein, and allows the lock male screw to move between a screwed position and a non-screwed position. A lock female screw which is screwable to a lock male screw, on which a locking operation is carried out, of the connector side to which a connection is made is mountable to the mounting opening.

According to a second preferred embodiment of the present invention, a connector device is uniquely constructed to allow connection of a female connector to a male connector. The connector device includes a lock male screw, a mounting opening, and a lock female screw. The lock male screw is screwable to a lock female screw, on which a locking operation is carried out, of a connector side to which a connection is made. The mounting opening allows insertion of the lock male screw therein, and allows the lock male screw to move between a screwed position and a non-screwed position. The lock female screw is mountable to the mounting opening when the lock male screw is retracted in the non-screwed position. The lock female screw is screwable to a lock male screw, on which a locking operation is carried out, of the connector side to which a connection is made.

Here, the connector side to which a connection is made refers to an apparatus, such as a computer, or a cable having a connector which is connected to the apparatus. The mounting opening has a diameter which is greater than the diameter of the lock male screw in order not to prevent movement of the lock male screw. A lock female screw on which a locking operation is carried out is preferably located at the wall surface of the connector side to which a connection is made.

With this structure, when the configuration of the connector on the connector side to which a connection is made and the configuration of the connector device are different, by making the lock male screw protrude from the mounting opening, and screwing it to the female screw on which a locking operation is carried out, firm connection of the female and male connectors with each other is maintained. When the configuration of the connector of the connector side to which a connection is made and the configuration of the connector device are the same, a cable having a connector which is different from that of the connector device and a lock male screw at each end thereof is, for example, used in order to connect the connector device and the male/female connector of the cable. At this time, after making the lock male screw retreat from the mounting opening of the connector device, the lock female screw is mounted to the mounting opening, and screwed to the lock male screw of the cable in order to maintain secure connection between the male connector and female connector. By connecting the female and male connectors of the connector side to which a connection is made and those of the cable, and by screwing the lock female screw, on which a locking operation is carried out, of the connector side to which a connection is made and the lock male screw of the cable, firm connection of the male and female connectors is maintained. As a result, the male/female form of the connector of the connector side to which a connection is made is changed. Therefore, even if, in order to connect the connector and the connector device, it is not possible to connect the lock male screw, the use of the lock female screw makes it possible to maintain the secure connection of the female connector to the male connector. Consequently, it is possible to achieve more reliable connection of the connector device and to make the connector device more versatile.

In one aspect of the second preferred embodiment of the present invention, a connecting internally threaded portion having a larger diameter than the lock male screw is provided at an inner wall of the mounting opening, and a threaded portion which is screwable to the connecting internally threaded portion is provided at an outer periphery of the lock female screw.

With this structure, when the lock female screw is screwed, it can be firmly and easily mounted to the mounting opening. In accordance with the configuration of the lock screw, the configuration of the lock screw of the connector device is easily changed.

In another aspect of the second preferred of the present invention, a first engaging portion for securing the lock female screw is provided at an inner wall of the mounting opening, and a second engaging portion for engagement with the first engaging portion is provided at an outer periphery of the lock female screw.

Here, the first and second engaging portions have, for example, key structures which prevent the rotation of the lock female screw or plunger structures which prevent it from falling off. According to these structures, the lock female screw is firmly and easily mounted to the mounting opening, such that the configuration of the lock screw of the connector can be easily changed in accordance with the configuration of the lock screw of to the device to which the connector is connected.

To achieve the above-described advantages, according to preferred embodiments of the present invention, the connector device having any one of the above-described structures is used in an interface module or an adapter for changing the number of cores of a connector. According to this structure, the interface module and the adapter for changing the number of cores of a connector are made more versatile, making it possible to achieve more reliable connection.

Other features, characteristics, elements and advantages of the present invention will become apparent from the following description of preferred embodiments thereof with reference to the attached drawings.

DETAIED DESCRIPTION OF PREFERRED EMBODIMENT

Figure 1A:
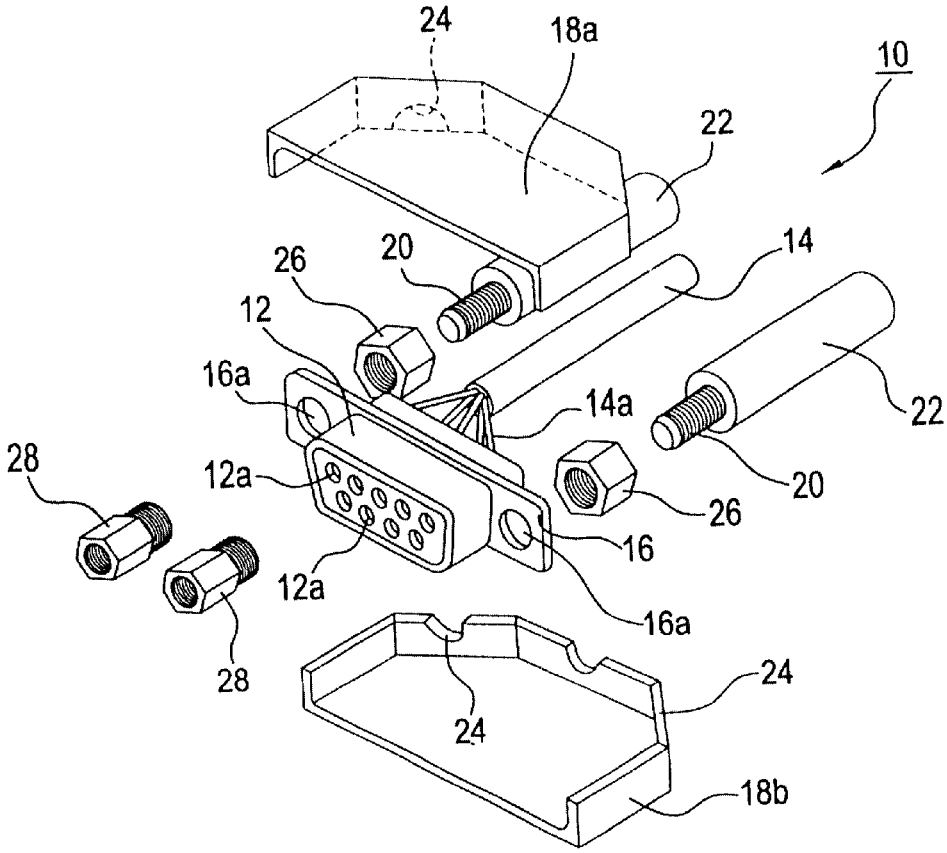
FIG. 1A is an exploded perspective view of a preferred embodiment of a connector device in accordance with the present invention.
Figure 1B:
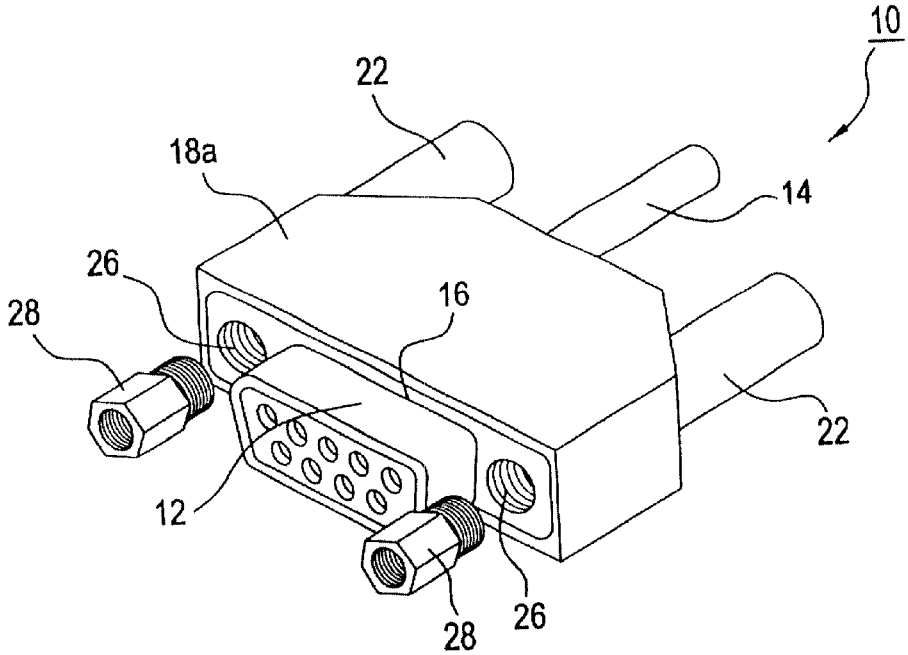
FIG. 1B is a perspective view showing the connector device in an assembled state.

A description of preferred embodiments of the present invention will be given with reference to the drawings. FIG. 1A is an exploded perspective view of a connector device 10 according to a preferred embodiment of the present invention, and FIG. 1B is a perspective view of the connector device 10 in an assembled state. In the present preferred embodiment, the connector device 10 incorporates a female connector 12 having a plurality of female connecting elements 12*a*. A cable 14 having bundled signal lines 14*a* connected to the corresponding female connecting elements 12*a* extend from the back surface of the female connector 12. The female connector 12 includes a flange 16 which protrudes towards the left and right. The flange 16 along with a top case 18*a* and a bottom case 18*b* define the outside surface of the connector device 10. Openings 16*a* are provided in the flange 16 to allow lock male screws 20 to protrude therefrom. The lock male screws 20 are screwable to the lock female screws 110 (that is, the female screws on which a locking operation is carried out, see FIG. 6A) of the apparatus 100, such as a computer. Grip portions 22 protrude towards the back end side (that is, the side in which the cable 14 is led out) of the connector device 10 through corresponding semicircular grip openings 24 provided in the top case 18*a* and the bottom case 18*b*. These grip portions 22 enable the lock male screws 20 to be screwed into the lock female screws 110. Although, in the present preferred embodiment, the female connector 12 is described as being provided on the connector device 10, a connector having the structure of the male connector 108 shown in FIG. 6B may be provided on the connector device 10.

The characteristics of the first preferred embodiment are such that the connector device enables the lock male screws to advance and retract with respect to the inside portion of the connector device, and that mounting openings which allow the mounting of lock female screws which are screwable to the lock male screws of the connector side to which a connection is made in order to properly use the lock male screws and the lock female screws as required, thereby making it possible to use the connector device in correspondence with the configurations of the lock screws of the connector side to which a connection is made.

Figure 2:
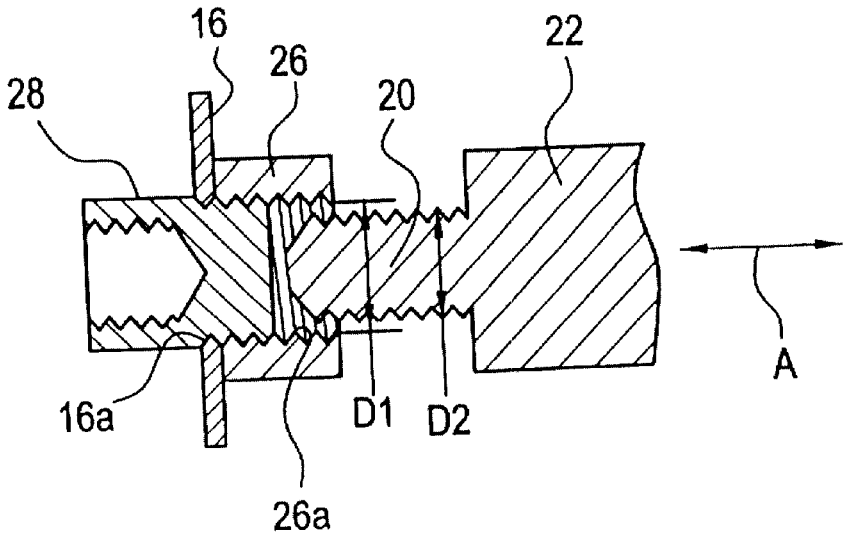
FIG. 2 illustrates the switching between a mounting state and a non-mounting state of lock female screws of a preferred embodiment of the connector device in accordance with the present invention.

In the present preferred embodiment, nuts 26 are secured as mounting openings to the back surface side of the flange 16 (that is, in the inside of the connector device 10 defined by the top case 18*a* and the bottom case 18*b*). As shown in FIG. 2, the nuts 26 are disposed coaxially with the centers of the openings 16*a* provided in the flange 16. A diameter D1 of a connecting internally threaded portion 26*a* of each nut 26 is preferably greater than a diameter D2 of its corresponding lock male screw 20 such that it does not prevent the advancing and retracting movement of each lock male screw 20 in the directions of the double-headed arrow A, that is, the movement between a screwed position and a non-screwed position with respect to its corresponding lock female screw 110 on which a locking operation is carried out (see FIG. 6A).

When, as shown in FIG. 2, the female connector 102 similar to the female connector 12 of the connector device 10 is provided on the apparatus 100, lock female screws 28 which are screwable to lock male screws of a low-cost changing cable (which, for example, has the lock male screws and a connector, in this case, a male connector, having the same shape provided on each end thereof) are removably screwed thereto. When the lock female screws 28 are screwed into the corresponding nuts 26, the lock male screws 20 are retracted (towards the right in FIG. 2) from the nuts 26 to provide screwing spaces for the lock female screws 28.

A description of the method of using the connector device 10 which is constructed as described above having the female connector 12 will be given. When the apparatus, such as a computer, has a male connector (that is, when the apparatus 100 shown in FIG. 6A has the male connector 108 shown in FIG. 6B), and when a side of the apparatus 100 is defined as the side to which a connection is made, the male connector 108 of the apparatus 100 and the female connector 12 of the connector device 10 are connected together in accordance with an ordinary connecting operation. In this case, the apparatus 100 is provided with female screws 110 on which a locking operation is carried out to maintain the connection of the connectors. Therefore, the lock female screws 28 are not mounted, and the grip portions 22 of the corresponding lock male screws 20 are pushed towards the left in FIG. 2. Then, the lock male screws 20 are extended to protrude from the flange 16 (which is the state shown in FIG. 6B) through the corresponding nuts 26. This causes the lock male screws 20 to rotate in the direction in which they are screwed, and to be screwed to the corresponding lock female screws 110 until a desired condition is reached, whereby the state of connection of the female connector 12 and the male connector 108 is maintained.

Figure 6A:
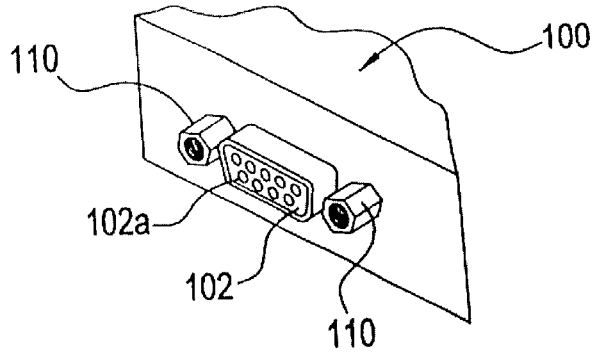
FIG.6A PRIOR ART
FIGS. 6A to 6C illustrate a conventional connector device having lock screws.
Figure 6B:
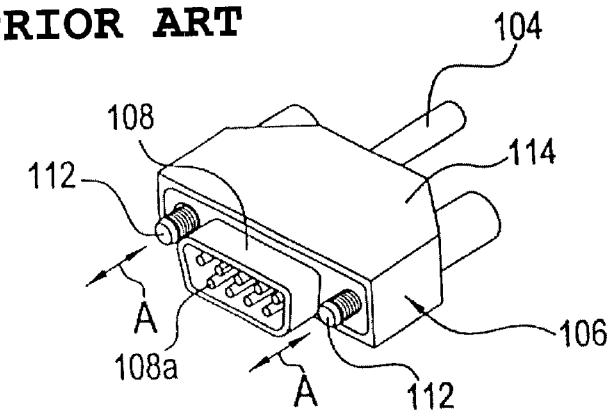
FIG.6B PRIOR ART
Figure 6C:
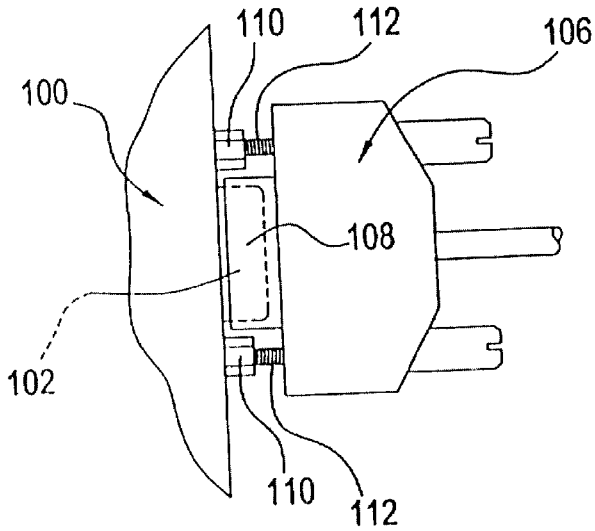
FIG.6C PRIOR ART
Figure 7A:
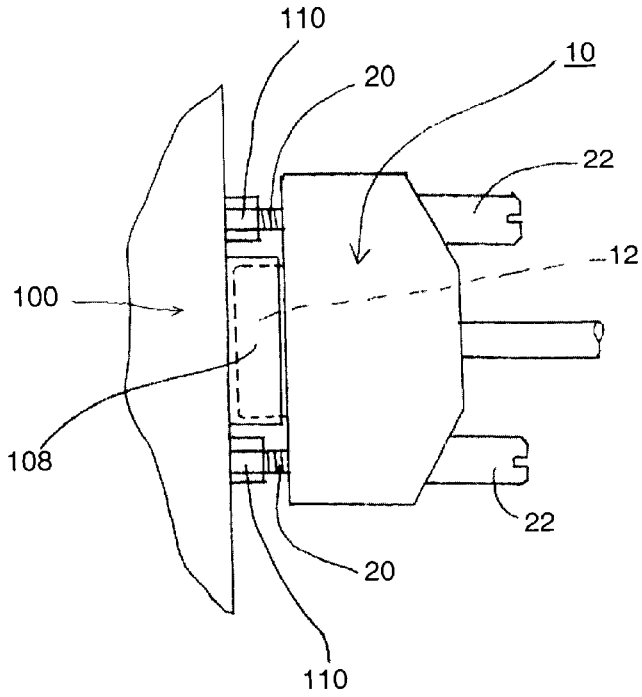
Figure 7B:
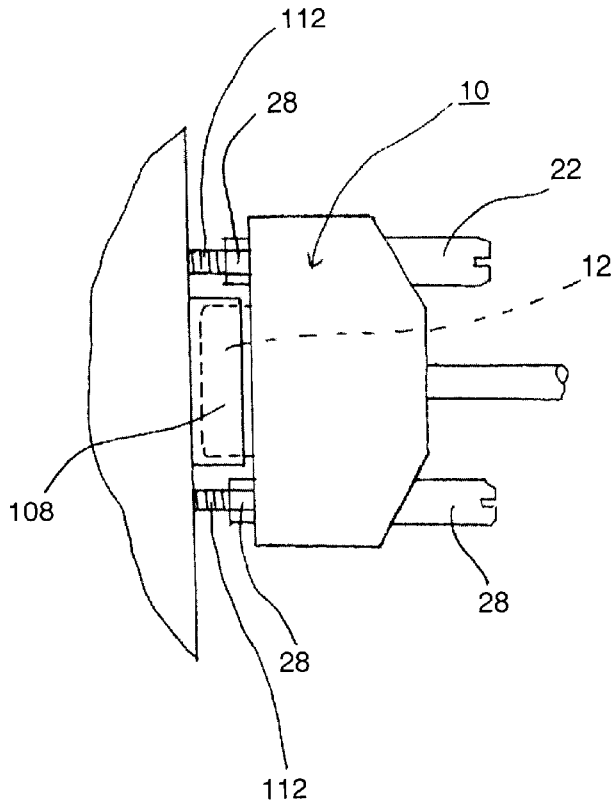

On the other hand, when, as shown in FIG. 6A, the connector side to which a connection is made (that is, the side of the apparatus 100) has the female connector 102, the female connector 102 has the same configuration as the female connector 12 of the connector device 10, such that they cannot be connected together. To make it possible to connect the apparatus 100 and the connector device 10, a changing cable for changing the configuration of the connector 102 of the apparatus 100 is connected to the female connector 102 of the apparatus 100. This changing cable has, for example, male connectors 108 shown in FIG. 6B provided on both ends thereof, and lock male screws 112 provided thereto. Therefore, when the apparatus 100 and the changing cable are connected, the female connector 102 and one of the male connectors 108 are connected as shown in FIG. 6C. At the same time, the lock female screws 110 and the lock male screws 112 are screwed together to provide a firm connection.

Next, the male connector 108 provided at the other end of the changing cable and the female connector 12 of the connector device 10 are connected together. At this time, the lock male screws 112 are provided on the changing cable. The grip portions 22 of the lock male screws 20 of the connector device 10 are pulled towards the right in FIG. 2 to cause the lock male screws 20 to retract with respect to the corresponding nuts 26. Thereafter, as shown in FIG. 1B and FIG. 2, the lock female screws 28 are screwed from the left side of the nuts 26 (that is, from the side of the flange 16). As a result, the lock screws of the connector device 10 have female screw structures. Thereafter, with the male connector 108 of the changing cable being connected to the female connector 12 of the connector device 10, the lock male screws 112 are rotated in the direction in which the lock female screws 28 are screwed, and are screwed until a desired condition is reached, whereby the state of connection of the male connector 108 and the female connector 12 of the connector device 10 with each other is maintained.

In this way, by switching the state of the lock female screws 28 with respect to the nuts 26 which define mounting openings of the connector device 10 between a mounting state and a non-mounting state, the apparatus 100 and the connector device 10 can be connected as a whole through a low-cost connecting connector even if it becomes impossible to connect the connector 12 of the connector device 10 when the form of the connector of the apparatus 100 changes. Here, the lock male screws and the lock female screws can be firmly connected together, so that the maintenance of the connection of the connected female and male connectors can be guaranteed, so that the reliability of the connection is maintained. In addition, even if the diameters of the lock male screws of the apparatus 100 are changed, only the lock female screws 28 must be exchanged in accordance with the diameters of the screws, thereby producing a more versatile connector device 10.

Figure 3A:
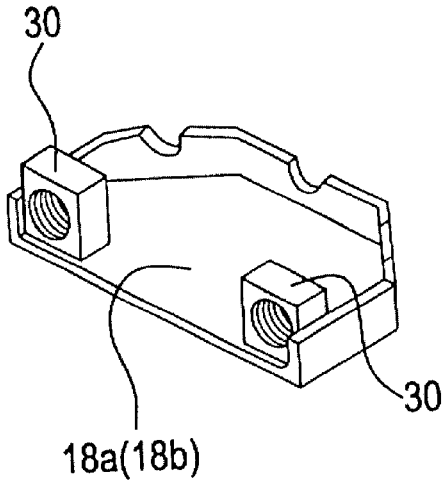
FIGS. 3A and 3B illustrate another form of mounting openings used in a preferred embodiment of the connector device in accordance with the present invention.
Figure 3B:
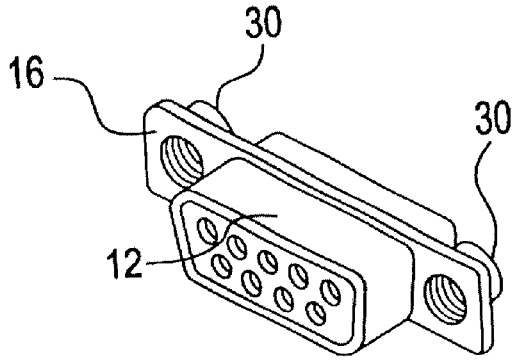

In the case illustrated in FIG. 1A, when the nuts 26 are used as mounting openings, nut mounting securing protrusions or grooves (not shown) provided at at least one of the top case 18*a* and the bottom case 18*b* are used to secure and dispose the nuts 26 inside the case. For example, as shown in FIG. 3A, mounting openings 30 may be integrally provided with either the top case 18*a* or the bottom case 18*b* during the formation of the mounting openings in either the top case 18*a* or the bottom case 18*b*. In particular, when the cases are made of resin, the mounting openings 30 can easily be integrally provided with either one of the cases 18*a* and 18*b*. In addition, as shown in FIG. 3B, the mounting openings 30 may be integrally provided by engraving connecting internally threaded portions by a tapping operation after a burning operation which is carried out when the flange 16 is being formed. By integrally forming the mounting openings 30 in either one of the cases or the flange in this way, for example, the number of parts and the number of steps required for the assembly operation are greatly reduced. As a result, the cost of the connector device 10 is greatly reduced, and the connector is much more versatile.

Figure 4:
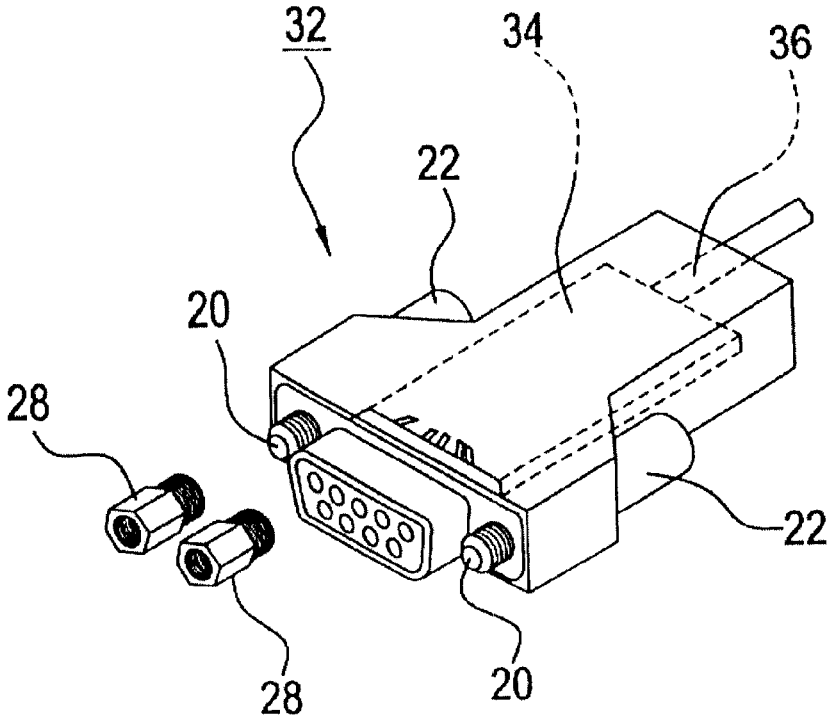
FIG. 4 illustrates an example of an application of a preferred embodiment of the connector device of the present invention to a communications interface module.

FIG. 4 illustrates an example of an application of the connector device 10 of the present preferred embodiment to a communications interface module 32. A substrate 34 is installed inside the cases. A separate connector cable 36 for a communications device to be connected is disposed at one end of the substrate 34. Even in this case, when the male/female configuration of the connector of the apparatus to which the communications interface module 32 is connected changes, such that it becomes necessary to use a changing cable, and the configurations of the lock screws change, by switching the states of the locking females screws 28 of the connector device 10 between the mounting state and non-mounting state, the lock screws can always be used. Therefore, the apparatus and the interface module 32 are securely connected together, and, thus, the communications interface module 32 is much more versatile.

Figure 5:
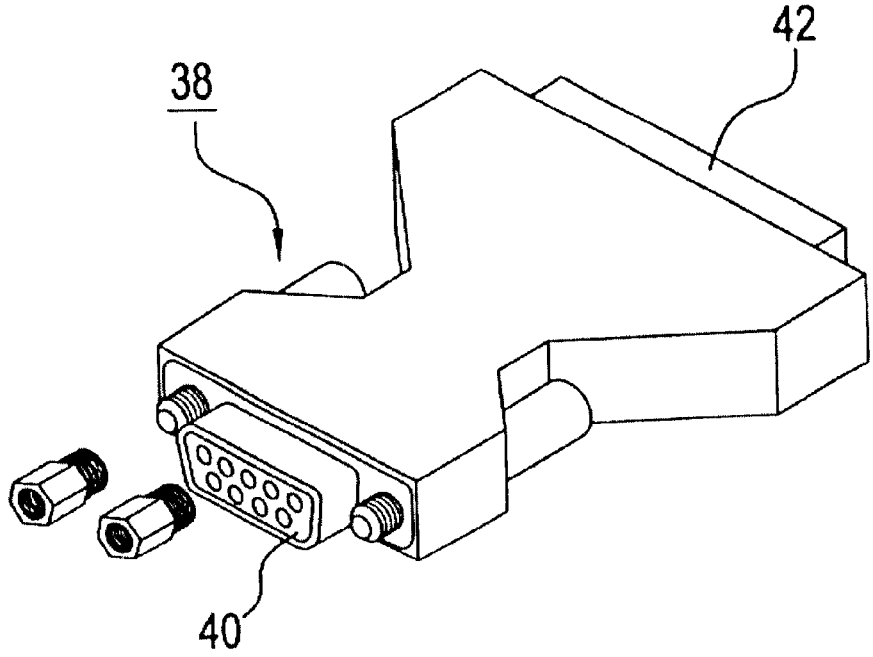
FIG. 5 illustrates an example of an application of a preferred embodiment of the connector device of the present invention to an adapter for changing the number of cores of a connector.

FIG. 5 is an example of an application of the connector device 10 of the present preferred embodiment to an adapter 38 for changing the number of cores of a connector. For example, a nine-core connector 40 is disposed at one end of a case, and a 25-core connector 42 is disposed on the other end of the case to make it possible to change the number of cores of the connector. Even in this case, when the male/female configuration of the connector of the apparatus to which the adapter 38 is connected changes, such that it becomes necessary to use a changing cable, and the configurations of the lock screws change, by switching the states of the locking females screws 28 of the connector device 10 between the mounting state and non-mounting state, the lock screws can always be used. Therefore, the apparatus and the adapter 38 are firmly secured together, and, thus, the adapter 38 is much more versatile. The 25-core-connector-42 side of the adapter 38 may have a lock-screw structure.

The applications of the above-described connector 10 are only examples. As long as the connector has lock screws, similar advantages are obtained even if it is adapted for other structures.

In the above-described preferred embodiments, a structure is described in which threaded portions are provided on the outer surfaces of the corresponding lock female screws 28, and are screwed and secured to the nuts 26 disposed as mounting openings. However, as long as the lock female screws 28 are secured, similar advantages are obtained even if other securing methods are used. In one example, key grooves (that is, first engaging portions) may be provided in the corresponding mounting openings, whereas, keys (that is, second engaging portions) which are fittable to the key grooves may be provided on the outer surfaces of the lock female screws 28 to prevent the lock female screws 28 from rotating and falling off. In another example, a plunger mechanism may be used.

In this way, by providing the lock female screws 28 with threaded structures, key structures, or plunger structures allowing them to be mounted to the mounting openings, even an end user can easily mount and dismount the lock female screws 28.

As can be understood from the foregoing description, according to preferred embodiments of the present invention, by switching the states of the lock female screws between a mounting state and a non-mounting state with respect to the mounting openings of the connector device, the lock screws of the connector can be used without being affected by the configurations of the lock screws of the connector side to which a connection is made. Therefore, the female and male connectors are firmly secured, such that the connector device is much more versatile.

By applying the connector device having lock female screws are capable of changing states between a mounting state and a non-mounting state with respect to the mounting openings to, for example, an interface module or an adapter for changing the number of cores of a connector, the lock screws can always be used even if it becomes necessary to use, for example, a changing cable, and the forms of the lock screws change when the male/female form of the connector of the apparatus changes. This makes it possible to firmly secure the apparatus and, for example, an interface module or an adapter for changing the number of cores of a connector together, and, thus, to make it possible to make the connector device more versatile.

While the invention has been described with reference to preferred embodiments, it will be understood by those skilled in the art that other modifications can be made without departing from the spirit and scope of the invention.

What is claimed is:

1. A connector device which allows the connection of a female connector and a male connector with each other to be maintained, the connector device comprising:

a lock male screw which is screwable to an apparatus lock female screw of an apparatus to which the connector device is to be connected;

a mounting opening having front and rear sides for freely inserting the lock male screw from the rear side, the opening allowing the lock male screw to move between an extended screwing position and a retracted non-screwing position; and a lock female screw which is screwable to an apparatus lock male screw of an apparatus to which the connector device is to be connected and the lock female screw being mountable to the mounting opening; wherein the lock male screw and the lock female screw are separate, independent elements.

2. A connector device according to claim 1, wherein said lock female screw which is mountable to the mounting opening while the lock male screw is retracted to the non-screwing position.

3. A connector device according to claim 2, wherein a connecting internally threaded portion having a larger diameter than an outside diameter of the lock male screw is provided at an inner wall of the mounting opening, and wherein a threaded portion which is screwable to the connecting internally threaded portion is located at an outer periphery of the lock female screw.

4. A connector device according to claim 2, wherein a first engaging portion for securing the lock female screw is provided at an inner wall of the mounting opening, and wherein a second engaging portion for engagement with the first engaging portion is located at an outer periphery of the lock female screw.

5. A connector device according to claim 1, further comprising a female connector including a flange from which said lock male screw protrudes.

6. A connector device according to claim 1, further comprising:

a top case and a bottom case each having substantially semicircular grip openings; wherein said lock male screw includes a grip portion which extends through said substantially semicircular grip openings.

7. A connector device according to claim 6, wherein said mounting opening is attached to one of said top case and said bottom case.

8. A connector device according to claim 6, wherein said top case and said bottom case are made of resin.

9. An interface module using the connector device according to claim 1.

10. An adapter for changing the number of cores of a connector including the connector device according to claim 1.

11. A connector device which allows a connection of a female connector and a male connector with each other to be maintained, the connector device comprising:

a lock male screw which is screwable to an apparatus lock female screw of an apparatus to which the connector device is to be connected; and a mounting opening having front and rear sides for freely inserting the lock male screw from the rear side, the mounting opening allowing the lock male screw to move between an extended screwing position and a retracted non-screwing position; and a lock female screw which is mountable to the front side of the mounting opening while the lock male screw is retracted to the non-screwing position, the lock female screw being screwable to an apparatus lock male screw of an apparatus to which the connector device is to be connected; wherein the lock male screw and the lock female screw are separate, independent elements.

12. A connector device according to claim 11, wherein a connecting internally threaded portion having a larger diameter than an outside diameter of the lock male screw is provided at an inner wall of the mounting opening, and wherein a threaded portion which is screwable to the connecting internally threaded portion is located at an outer periphery of the lock female screw.

13. A connector device according to claim 11, wherein a first engaging portion for securing the lock female screw is provided at an inner wall of the mounting opening, and wherein a second engaging portion for engagement with the first engaging portion is located at an outer periphery of the lock female screw.

14. A connector device according to claim 11, further comprising a female connector including a flange from which said lock male screw protrudes.

15. A connector device according to claim 11, further comprising:

a top case and a bottom case each having substantially semicircular grip openings; wherein said lock male screw includes a grip portion which extend through said substantially semicircular grip openings.

16. A connector device according to claim 15, wherein said mounting opening is attached to one of said top case and said bottom case.

17. A connector device according to claim 15, wherein said top case and said bottom case are made of resin.

18. A connector device according to claim 14, wherein nuts are securely mounted on a back surface of said flange wherein an internal diameter of said nuts is greater than an outside diameter of said lock male screw.

19. An interface module using the connector device according to claim 11.

20. An adapter for changing the number of cores of a connector including the connector device according to claim 11.

* * * * *